United States Patent [19]

Fallon et al.

[11] Patent Number: 4,736,926

[45] Date of Patent: Apr. 12, 1988

[54] VALVE ASSEMBLY AND COUPLER THEREFOR

[75] Inventors: Merton R. Fallon; John R. Froehler, both of Northridge, Calif.

[73] Assignee: Draft Systems, Inc., Northridge, Calif.

[21] Appl. No.: 928,183

[22] Filed: Nov. 7, 1986

[51] Int. Cl.[4] ..... B67D 5/54

[52] U.S. Cl. ..... 251/149.9; 137/212; 137/322; 285/88; 285/317; 285/320

[58] Field of Search ..... 137/212, 614.06, 322; 251/149.9; 285/87, 88, 317, 320

[56] References Cited

U.S. PATENT DOCUMENTS 2,520,215 8/1950 Kerr ..... 285/320 X
4,102,356 7/1978 Knight ..... 251/149.9 X
4,305,421 12/1981 Fallon ..... 137/312 X
4,458,719 7/1984 Strybel ..... 285/320 X
4,612,952 9/1986 Fallon ..... 137/312

*Primary Examiner*—Alan Cohan

[57] ABSTRACT

An improved coupler or tapping mechanism and valve system for obtaining access to a container of fluid. In a container of fluid, and particularly a keg for beer, a valve assembly receiving member or keg neck extends from the top of the container. This keg neck receives a flat top, dual valve system which is operated by the coupler. The improved coupler is placed over the keg neck and is positively secured thereto and sealed relative to the valve assembly by a two point locking mechanism which engages the external surfaces of the keg neck. A safety locking mechanism is provided which prevents removal of the coupler from the keg neck as long as the dual valves are in an open fluid tapping position.

4 Claims, 2 Drawing Sheets

110
122
10
124
126
128
129
100
130
122
130a
102
104
134
-132-
70
3
130b
84a
-112-
71
80
84c
84
83
88
103
82
76
72
119
74
69
73
18a
37
34
114
36
77
108
84b
18
58
4
4
46
55
16
116
3
24
56
30
118
54
12
26
64
67
61
17
17
22
14
32
28
47
52
62
50
48
65
68
19

VALVE ASSEMBLY AND COUPLER THEREFOR

BACKGROUND OF THE INVENTION

1. Field of the Invention

The present invention relates generally to valving devices for use in beverage dispensing systems, particularly those systems for drawing liquids, such as beer, from containers, such as beer kegs or barrels, using a gas to drive the liquid from the container. More particularly the present invention relates to an improved coupler for positive interconnection with a so-called "flat top" type of fluid container valve system for taping the valve system to draw liquid from the container.

2. Discussion of the Prior Art

In systems for tapping kegs of fluid and particularly containers of beer there has been used a valve assembly secured to the top of the keg for providing access to the fluid ultimately to be delivered from the keg to a remote position for distribution. Typically, the valve assembly includes a dual valve arrangement with a siphon tube which extends from the valve assembly to the bottom of the keg. The valve assembly is fixed within the keg neck or other valve receiving member to provide a valved access to the fluid once it is pressurized. The valve system, when tapped by a coupler or some other keg tapping means connected to a pressure source, allows pressurized gas to flow into the keg until the desired pressure within the keg is achieved to force the fluid out of the keg through the valve system and ultimately to a distribution device where the fluid can be used to fill glasses and the like. The valve system is one which allows the pressurized gas, usually carbon dioxide, to be forced out of the keg to distribution device until the keg is entirely emptied of fluid. Typically the valve system includes a recessed portion into which the coupler, or tapping mechanism, is closely received.

With regard to the coupler or other tapping mechanism, such mechanisms are typically inserted by rotation into the recessed portion of the valve assembly. Then by separate action, the handle is actuated to open the valves and permit the flow of fluid into and out of the keg in the appropriate channel. After the fluid has been completely dispensed from the keg, the reverse sequence is followed to reseal the valves. If the aforementioned sequence is followed, there will be no loss of fluid or gas in the tapping or untapping procedure.

One of the most effective systems ever devised to overcome the drawbacks of the prior art is described in U.S. Pat. Nos. 4,159,102 and 4,181,143. Broadly stated, the systems described in these patents provided better sealability between movable parts to prevent unnecessary leakage, safe operability to protect the operator even from his own errors, and constructional features facilitating cleaning operations and economic savings in manufacturing and assembly, among others. These systems use a coupler device which has a coupler body provided with a wedge surface which is helical in configuration circumscribing the bottom of the coupler body. The wedge surface is adapted to engage inwardly protruding lugs formed on the valve assembly. With this construction, upon rotation of the coupler into the valve system, the interaction of the wedge surfaces with the lugs forces the coupler body downwardly within the recessed portion of the valve assembly and into a sealing relationship with a flat surface provided proximate the bottom of the coupler receiving recess formed in the valve system.

The thrust of the present invention is directed toward providing an improved coupler assembly which can be used with a "flat top" valve system, that is, a valve system which does not have a coupler receiving recess. Flat top systems have several advantages including the absence of the coupler receiving recess which is difficult to clean and acts as a sump within which liquids and other foreign materials can accummulate. As will be apparent from the description which follows, the coupler assembly of the present invention is placed over the flat top surface of the valve system, rather than into a recess formed in the valve system and is positively secured to the outside surfaces of the keg neck or valve assembly receiving member. This permits both the valve system and the coupler to be more compact and avoids the necessity of forming the complex wedge surfaces on the coupled body. The problems inherent in forming the wedge surface engaging ears on the valve system and the propensity of these ears to possibly bend or break in operation is also uniquely avoided. Additionally, cleaning is simplified. The accummulation of foreign materials within the recess is avoided and superior sealing to atmosphere is achieved due to the unique design of the coupler to flat top sealing means of the invention.

SUMMARY OF THE INVENTION

It is an object of the invention to provide an improved coupler assembly for use in tapping dual valve systems of the type commonly used in beverage dispensing systems. More particularly, an object of the invention is to provide a coupler assembly which is usable with flat top valve systems, that is, valve systems which do not have coupler receiving recesses. Locking and sealing of the coupler to the valve system is accomplished by a novel locking mechanism which engages the external surfaces of the valve assembly receiving member which is affixed to the beverage container.

Another object of the invention is to provide an improved coupler assembly of the aforementioned character which is compact, durable in use, inexpensive to manufacture and one which need not be rotationally oriented with respect to the container valve system prior to its interconnection therewith.

Another object of the invention is to provide a two point locking mechanism which positively locks the coupler to the external surfaces of the valve system and at the same time accomplishes a positive seal of the coupler to the flat to surface of the valve system.

A further object of the invention is to provide a coupler as described in the preceding paragraph in which the locking mechanism cooperates with the valve actuation mechanism of the coupler to positively prevent removal of the coupler from the valve system when the valves are in an open, operable position.

Another object of the invention is to arrive at an economical device whose parts are simple to manufacture but still achieve the tolerances necessary for sealing and avoid the complexity which has characterized such devices in the past to enhance the repeatability and extend the life of the device.

A further object is to provide an improved coupler or tapping mechanism of the character described to operate the valves in the valve assembly substantially without leakage, particularly during attachment and detachment of the coupler with the valve mechanism.

These and other objects of the invention will become clear from the description of the invention which follows.

BRIEF DESCRIPTION OF THE DRAWINGS

FIG. 1 is a side elevational, cross-sectional view showing the improved coupler of the invention operably coupled with a flat top type valving mechanism comprising a valve assembly mounted within a valve receiving member, or neck, extending from the top portion of a container such as a beer keg or the like.

DESCRIPTION OF THE INVENTION

Figure 1:
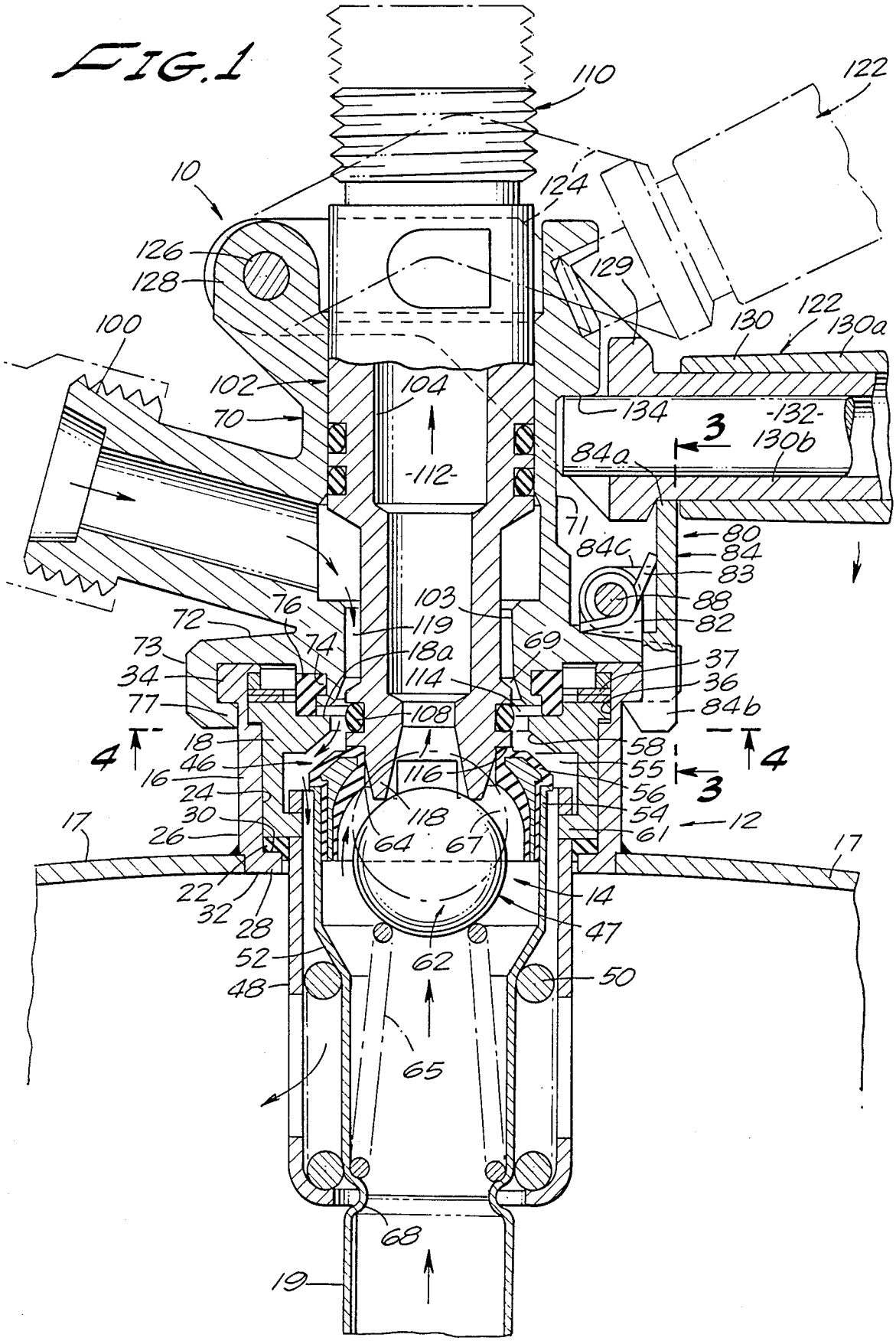

Referring to the drawings and particularly to FIG. 1, there is shown the improved coupler of the present invention 10 operably coupled with a valving mechanism 12. Valving mechanism 12 functions to seal a container of fluid such as a beer keg and comprises a valve assembly 14 for providing access to the container and a valve assembly receiving member, or neck, 16 secured to a container 17 as by welding. Valve assembly 14 includes a valve body 18 having a siphon tube 19 extending from the bottom of the valve body to a position adjacent to the bottom of the container.

The coupler 10 of the invention, operably coupled with the valving mechanism 12, is secured to the valve assembly 14 in a manner which allows pressure to be imparted through the coupler to the interior portions of the container for pressurizing the liquid therein and also provides an outlet for the liquid to a conduit downstream of the coupler assembly.

As indicated in FIG. 1, an elastomeric O-ring 22 is secured between neck member 16 and the valve assembly 14 so that neither fluid under pressure nor the gas providing the pressure can leak between the joints of the valve assembly and the member 16. The valve assembly receiving member, or neck, 16 is generally cylindrical having an inner surface 24 and an outer surface 26. An annular ring 28 extends radially inwardly from the inner surface of the bottom portion of the neck member 16. This annular ring 28 has an upper surface 30 for engaging a portion of the deformable O-ring 22 and a lower surface 32 which is welded adjacent to the top of the container. The top portion of member 16 defines circumferentially rounded rim portion 34 which has an inner groove 36 therein extending entirely around the circumference of the inner surface 24 for receiving a resilient retainer ring 37. With this construction the valve body 18 is held securely in position within valve assembly receiving member, or neck, 16 and controllably compresses O-ring 22 to achieve a leak tight seal between the valve body and the neck.

The valve assembly 14 comprises dual valves including a first valve 46 and a second valve 47 operating concentrically with each other about the axis of the siphon tube. In FIG. 1 both of these valves are shown in an open configuration. Included with the first valve 46 is a spring retainer cup 48 for holding a helical compression external spring 50. The siphon tube 19 has a flared portion 52 near its top portion 54 which engages the top of the helical external spring 50. The bottom portion of the spring 50 rests on the bottom of the cup 48 as shown. The spring 50 is maintained between the bottom of the cup 48 and the flared portion 52 of the siphon tube 19 normally in a compressed position to bias the tube upwardly to maintain the first valve 46 in a normally closed position sealing annular first valve opening 55. A first valve member 56 is carried by the top portion 54 of the top of the siphon tube and engages a first valve seat 58. The helical spring 50 is its normal position maintains the engagement between the first valve member 56 and the valve seat 58 until the spring is compressed even further downwardly in the manner shown in FIG. 1 to allow displacement of the first valve member 56 away from the first valve seat 58 thereby opening the first valve 46. Retainer cup 48 is apertured about its periphery to receive locking ears 61 which ears function to interconnect valve body 18 and retainer cup 48.

The second valve 47 includes a second valve member 62 biased against a second valve seat 64 by an internal spring 65 to sea a second valve opening 67. Displaced from the top portion 54 of the siphon tube are three circumferentially equidistant bulges 68 on the interior portion of the tube formed by impressing dimples on the exterior of the siphon tube. These bulges 68 provide a surface against which the bottom portion of the internal helical spring 65 rests. The top portion of the internal spring 65 engages the second valve member or ball 62 and presses it against the second valve seat 64 defined on the first valve member 56 as shown to maintain the second valve in a normally closed position. To open the second valve 47, the internal spring 65 is compressed as shown in FIG. 1 allowing the ball 62 to be displaced from the second valve seat 64. In this way, the second valve closes and opens the opening 67 and the first valve 46 opens and closes the opening 55 which is concentric with opening 69 in valving mechanism.

The component parts of the valve assembly and the details of their assembly are more fully described in U.S. Pat. No. 4,181,143 issued to the common assignee of the present invention.

The improved coupler assembly 10 cooperates with the valve mechanism to open and close the valves 46 and 47. More particularly the coupler assembly cooperates with the valve mechanism to open the passageways along with the exterior portion and through the interior portion of the siphon tube by moving valve members 56 and 62 away from their respective valve seats.

As best seen in FIG. 1, coupler assembly 10 has a coupler body 70 which can be constructed of metal or plastic in the shape of a hollow cylinder. Body 70 includes a first cylindrical portion 71 and a second enlarged diameter lower flange portion 72 having a downwardly depending peripheral skirt portion 73. Portion 72 is provided with a circumferential groove 74 adapted to receive an elastomeric sealing ring 76 which sealably engages the flat upper surface 18*a* of member 18 when the coupler 10 is mateably interconnected with the valving system. The manner in which the coupler is mated with the valving system to compress the sealing ring 76 will be discussed in the paragraphs which follow.

Figure 2:
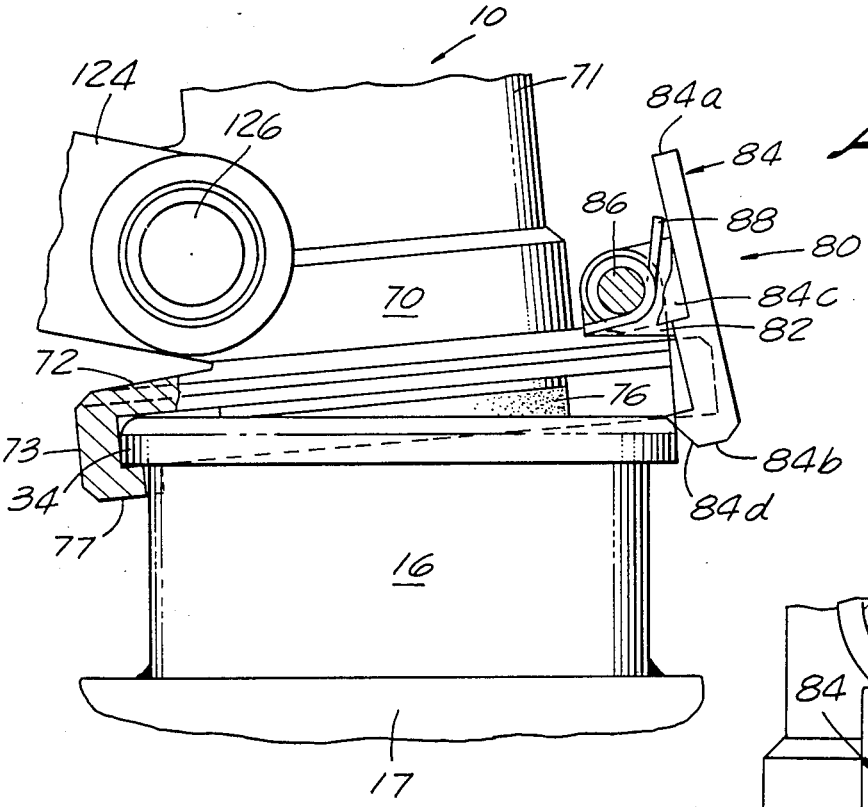
FIG. 2 is an enlarged fragmentary side elevational view of the lower portion of the body of the coupler and the upper portion of the valving mechanism showing the position of the coupler immediately prior to being lockably engaged with the neck of the valving mechanism.
Figure 4:
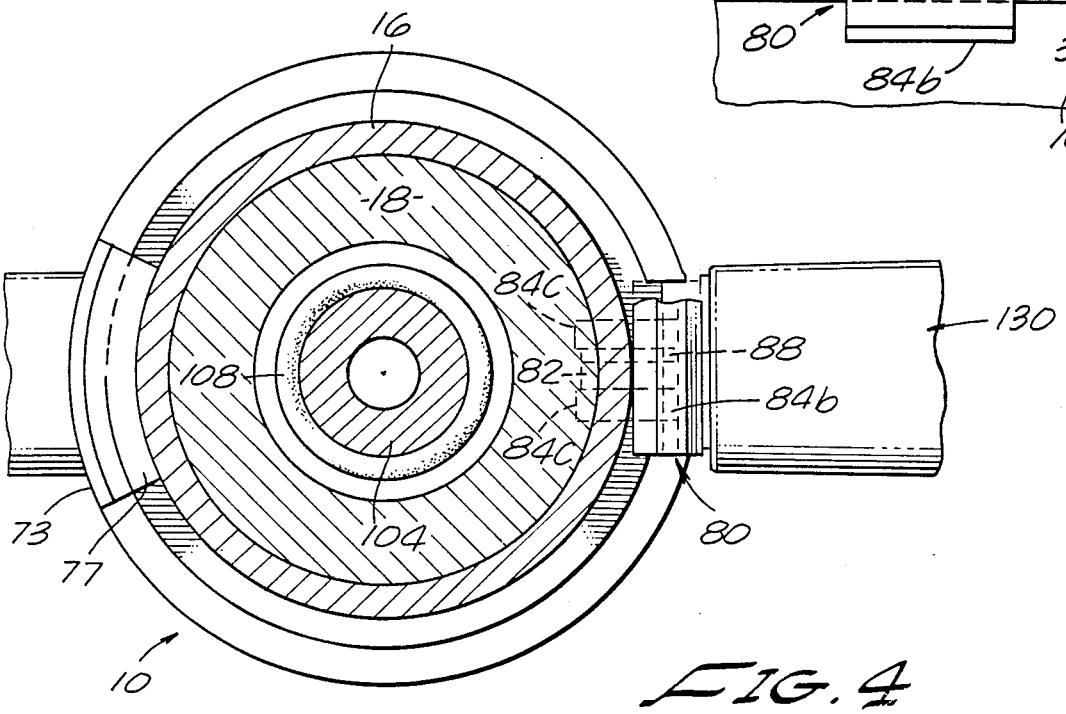
FIG. 4 is a fragmentary view taken along lines 4—4 of FIG. 1 showing the coupler interconnected with the neck.

As seen by also referring to FIGS. 2 and 4, skirt 73 of enlarged diameter body portion 72 of coupler body 70 is provided with a radially inwardly extending arcuate lip portion 77 (FIG. 4) which is lockably receivable under an arcuate segment of rim portion 34 of neck member 16. Segment 77 forms a part of the locking means of the present form of the invention for interlocking the coupler with the valving mechanism. Spaced apart by approximately 180 degrees from segment 77 is a latching arm mechanism 80 which also forms a part of the locking means of the invention. In the embodiment of the invention shown in the drawings, the locking means comprises an upstanding boss 82 mounted on the upper surface of enlarged diameter body portion 72 and a latching element 84 pivotally interconnected with boss 82.

Figure 3:
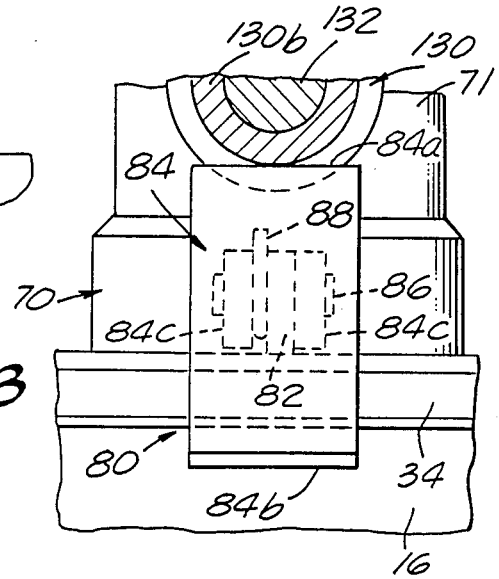
FIG. 3 is a fragmentary end view of the coupler and locking mechanism used to connect the coupler to the neck taken along lines 3—3 of FIG. 1, showing the locking mechanism in locking engagement with the neck.

Referring to FIGS. 2 and 3, latching element 84 has an upper extremity 84*a*, a lower hook-shaped extremity 84*b* and a pair of transversely spaced apart inwardly extending arms 84*c* disposed intermediate extremities 84*a* and 84*b*. Arms 84*c* are apertured to receive a pivot pin 86 carried by boss 82. Latching element 84 is pivotally movable from a first position shown in FIG. 1 wherein hook end 84*b* is hooked around the peripheral bead 34 of the neck member, into a second position wherein the hook end is moved radially outwardly relative to bead 34 to permit movement of the coupler from the locked interconnected position into the position shown in FIG. 2. As indicated in FIG. 2 by moving latching element 84 into the second position the hook end 84*b* can be decoupled from the peripheral bead 34 and the coupler can be tiltably raised relative to the valving system.

Also forming a part of the locking means of the invention is biasing means for yieldably urging against pivotal movement of the latching element 84 from the first to the second position. In the present embodiment of the invention the biasing means is provided in the form of a torsion spring 88 carried by pivot pin 86. As shown in FIG. 1, one leg of the torsion spring 88 acts against flange 72 while the other leg of the spring acts against the latching element to urge it into the first locking position about rim 34 as shown in FIG. 1.

In interconnecting the coupler assembly with the valve assembly, the coupler assembly is first angularly inclined relative to neck 16 so that lip portion 77 is disposed under rim 34 (FIG. 2). In this position, the angularly inclined face 84*d* of latching element 84 is in engagement with the upper edge of rim 34. Next, flange 72 is moved into a parallel orientation with the top of rim 34. This causes the hook portion 84*b* of element 84 to pivot outwardly against the urging of spring 88 toward its second position allowing the coupler to seat against rim 34 of the neck 16. A downward force on the coupler assembly will compress elastomeric sealing ring 76 against the flat top surface 18*a* and will permit the hook-like extremity 84*b* of the latching element to move under rim 34 thereby sealably interlocking together the coupler assembly and the valve assembly in the manner shown in FIG. 1. The assemblies will remain sealably interlocked together until element 84 is moved to its second position by exerting a radially inward force on the upper extremity of element 84 against the urging of spring 88 thereby permitting the coupler assembly to be raised to the position shown in FIG. 2.

Coupler assembly 10 includes a side fitting 100 through which gas is forced under pressure into the container 17 through the passageway formed when the first valve 46 is in the open position. Also forming a part of the assembly is a probe 102 which is reciprocally movable within a bore 103 formed axially of body 70. In a manner presently described, probe 102 is movable within bore 103 between an open and closed position to actuate the valves 46 and 47. Probe 102 comprises a shaft 104 carrying a lower piston 106. Piston 106 has fixed in its periphery a sealing ring 108 to seal the interface between the piston and the inner walls of the bore 103. The portion of the shaft 104 extending upwardly above the top of the coupler body 70 carries a top fitting 110 which provides a means for coupling with tubing or other conduits for delivering the fluid which is forced out of the container or keg when the coupler assembly 10 is in the valve opening position. For this purpose shaft 104 is provided with a fluid passageway 112 along its longitudinal axis from one end of the shaft to the other.

Lower piston 106, when moved to the valve opening position, shown in FIG. 1, extends beyond the bottom of the coupler body to provide an annular opening 114 therethrough. Thus, in the open position, an annular passage is formed through the bottom of the coupler body, along the space between the shaft 104 to the side fitting for the gas used in pressurizing the keg.

The bottom of the lower piston 106 has a first valve member engaging surface 116 surrounding the axial fluid passageway 112. On either side of the opening fork members 118 extend downwardly from the lower piston 106. These fork members are dimensioned to pass through the second valve opening 67 and engage ball 62. Similarly, piston 106 is dimensioned to pass through the first valve opening 67 so that surface 116 can engage in sealing relationship the first valve member 56 to open the valve in the manner shown in FIG. 1.

With the above configuration, when coupler assembly is engaged with the valve body the probe can be moved from a closed or retracted position to the open or extended position shown in FIG. 1, where the valves are opened allowing the flow of fluids in and out of the keg through the various passages in the coupler assembly. In the open or extended position as shown in FIG. 1, the fork member 118 engages ball 62 displacing it from second valve seat 64 thereby opening the second valve and allowing fluid under pressure to pass through the siphon tube 19 around ball 62, out of second valve opening to the top fitting 110. Similarly, in the extended position, the first valve member engaging surface 116 on the lower piston engages the first valve member 56 displacing downwardly away from the first valve seat to open the first valve. In this open position the gas used to pressurize the keg is allowed to flow in the side fitting 100 through the passageway 119, through the annular space between the shaft and the inner walls of bore 103 and through the first valve opening 55 into the keg.

During the downstroke of the probe, the fork member 118 will engage the ball 62 prior to the engagement of the lower piston with the first valve member 56. As a consequence the second valve 47 will be opened slightly before the first valve 46. Upon reaching its full extension the first valve member engaging surface of the lower piston in addition to opening the first valve seals the interface between the piston and the valve members thereby preventing leakage between the gas and fluid flow paths. To close the valves 46 and 47 the probe is retracted to the closed position disengaging lower piston to disengage the valve members 56 and 62 allowing them to revert to their normally closed position.

Movement of the probe downwardly is achieved by operation of a lever assembly 122. The lever assembly 122 has two arms 124 spaced from each other having one end connected by pivot pin 126 to a protuberance 128 which extends from the top of the coupler body. The other end of arms 124 carries a cross-bar 129 from which extends a handle assembly 130 comprising internal and external portions **130*a* and 130*b*** respectively for use by the operator in moving the lever from an open position to a closed position.

A highly important aspect of the present invention is the previously described locking means for releasably securing the coupler assembly to the valve receiving member which, in turn, is secured to the fluid container, or keg. In the previously mentioned prior art patents to Fallon, including U.S. Pat. No. 4,181,143, a wedge surface, which circumscribed the bottom portion of the coupler assembly, mated with lugs provided on the valve body to secure the coupler assembly to the valve assembly. The locking means of the present invention improved upon this arrangement by providing a positive means for interconnecting the coupler assembly directly with the circumferential rim portion of the valve assembly receiving member, or keg neck 14, which is securely affixed to the keg.

Forming an equally important aspect of the present invention is a safety means which cooperates with the latching element of the locking means to prevent movement of the latching means to a second position when the probe member of the valving assembly is in its second or valve opening position as depicted in FIG. 1.

As previously discussed, in order to move the probe downwardly, lever assembly 122 is moved from the upraised position shown by the phantom lines in FIG. 1 to the downward position shown by the solid lines. In this position, an inner shaft 132 telescopically carried internally of handle 130 is moved into locking engagement with a radially outwardly extending shoulder 134 formed on the coupler body thereby maintaining the valves in the open position shown in FIG. 1. Handle 130 comprises an outer gripping portion **130*a* and an inner cylindrical portion 130*b* having an enlarged diameter extremity 129. As the lever assembly is moved into the downward latched position a part of internal handle 130*b* located inwardly of external handle portion 130*a* moves into close proximity with extremity 84*a* thereby preventing movement of the latching element into the second release position shown in FIG. 2. Since latching element 84 cannot be moved into the second position, the coupler assembly cannot be disengaged from the neck 16 of the valving assembly so long as the valves are in the open position shown in FIG. 1**.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

We claim:

1. A coupler assembly for use with a valve sealing arrangement for sealing a container of fluid of the type having a valve assembly for providing access to the container and a valve assembly receiving member secured to the container, said valve assembly receiving member having a longitudinally extending axial centerline, a peripheral rim portion and at least one valve therein having a flat surface disposed proximate said peripheral rim portion and being operable by said coupler assembly when said assembly is connected to said valve receiving assembly to move said valve between an open and a closed position, said coupler assembly comprising:

(a) a coupler body having longitudinally extending axial centerline and first and second portions, said second portion being receivable over said peripheral rim portion of said valve assembly receiving member;

(b) sealing means carried by said second portion of said coupler body for sealably engaging said flat surface of said one valve when said coupler assembly is connected to said valve assembly receiving member;

(c) a probe member adapted to cooperate with said valve of said valve assembly when said coupler assembly is connected to said valve receiving assembly, said probe member being movable within said coupler body between a first position wherein said valve is closed to a second position wherein said valve is open; and (d) locking means for automatically releasably securing said coupler assembly to said valve assembly receiving member upon movement of said coupler assembly relative to said valve assembly receiving member from a first position wherein said axial centerline of said coupler assembly is angularly inclined relative to the axial centerline of the valve assembly receiving member to a second position wherein said coupler assembly and said valve assembly receiving member are axially aligned, said securement means comprising:

(i) a first radially inwardly extending arcuate segment carried by said second portion of said coupler body for engagement with said peripheral rim portion of said valve receiving member;

(ii) a latching member pivotally connected to said coupler body and circumferentially spaced from said arcuate segment for movement between a first position in locking engagement with said peripheral rim portion of said valve assembly receiving member to a second position spaced apart from said peripheral rim portion of said valve assembly receiving member; and (iii) biasing means for yieldably urging against movement of said latching member toward said second position, said latching member having a first hook-like extremity including an outer surface engageable with said valve assembly receiving member upon movement of said coupler assembly toward said second position to automatically urge said latching member toward said second position.

2. A coupler assembly as defined in claim 1 including safety means carried by said coupler body for preventing movement of said latching means to said second position when said probe member is in said second position.

3. A coupler assembly as defined in claim 2 in which said coupler assembly includes a lever assembly operably coupled with said probe member for moving said probe member between a valve opening and a valve closing position and in which said safety means comprises a second extremity provided on said latching member, said second extremity being located so that when said latching member is in said first position and said lever assembly has moved said probe into a valve opening position, said lever assembly engages said second extremity to block movement of said latching member between said first and second positions.

4. A coupler assembly for use with a valve sealing arrangement for sealing a container of fluid of the type having a valve assembly for providing access to the container and a valve assembly receiving member secured to the container, said valve assembly receiving member having a longitudinally extending axial centerline, a peripheral rim portion and at least one valve therein having a flat surface disposed proximate said peripheral rim portion and being operable by said coupler assembly when said assembly is connected to said valve receiving assembly to move said valve between an open and a closed position, said coupler assembly comprising:

(a) a coupler body having longitudinally extending axial centerline and first and second portions, said second portion being receivable over said peripheral rim portion of said valve assembly receiving member;

(b) sealing means carried by said second portion of said coupler body for sealably engaging said flat surface of said one valve when said coupler assembly is connected to said valve assembly receiving member;

(c) a probe member adapted to cooperate with said valve of said valve assembly when said coupler assembly is connected to said valve receiving assembly, said probe member being movable within said coupler body between a first position wherein said valve is closed to a second position wherein said valve is open; and (d) an operating handle pivotally connected to said coupler body, said operating handle including an outer surface and being pivotally movable between a valve opening position and a valve closing position;

(e) locking means for automatically releasably securing said coupler assembly to said valve assembly receiving member upon movement of said coupler assembly relative to said valve assembly receiving member from a first position wherein said axial centerline of said coupler assembly is angularly inclined relative to the axial centerline of the valve assembly receiving member to a second position wherein said coupler assembly and said valve assembly receiving member are axially aligned, said securement means comprising:

(i) a first radially inwardly extending arcuate segment carried by said second portion of said coupler body for engagement with said peripheral rim portion of said valve receiving member;

(ii) a latching member pivotally connected to said coupler body and circumferentially spaced from said arcuate segment approximately 180° for movement between a first position in locking engagement with said peripheral rim portion of said valve assembly receiving member to a second position spaced apart from said peripheral rim portion of said valve assembly receiving member, said latching member comprising a first hooklike portion and a second elongated portion having a substantially flat end; and (iii) biasing means for yieldably urging against movement of said latching member toward said second position said hook-like portion of said latching member including an outer surface engageable with said valve assembly receiving member upon movement of said coupler assembly toward said second position to automatically urge said latching member toward said second position; and (e) safety means carried by said coupled body for preventing movement of said latching means to said second position when said probe member is in said second position, said safety means comprising a portion of said outer surface of said operating handle, said portion of said outer surface being movable into close proximity with said flat end of said second elongated portion of said latching member when said valve is in an open position, said portion of said outer surface of said operating handle blocking movement of said latching member toward said second position.

* * * * *